US006389628B1

(12) United States Patent
Sears

(10) Patent No.: US 6,389,628 B1
(45) Date of Patent: May 21, 2002

(54) BALANCE RING

(75) Inventor: Jeffrey L. Sears, Grinnell, IA (US)

(73) Assignee: Maytag Corporation, Newton, IA (US)

( * ) Notice: Subject to any disclaimer, the term of this patent is extended or adjusted under 35 U.S.C. 154(b) by 100 days.

(21) Appl. No.: 09/655,812

(22) Filed: Sep. 6, 2000

(51) Int. Cl.[7] ..... D06F 37/24
(52) U.S. Cl. ..... 8/159; 68/23.2; 74/573 F
(58) Field of Search ..... 8/158, 159; 68/23.2; 210/144; 74/573 F

(56) References Cited

U.S. PATENT DOCUMENTS

| | | | | | |
|---|---|---|---|---|---|
| 2,538,246 | A | * | 1/1951 | Holm-Hansen | 68/23.2 X |
| 3,610,069 | A | | 10/1971 | Tanner | 74/573 |
| 4,044,626 | A | | 8/1977 | Hayashi et al. | 74/573 |
| 4,502,303 | A | | 3/1985 | Wasemann | 68/23.2 |
| 5,829,084 | A | | 11/1998 | Fujiwara | 8/158 |
| 5,855,127 | A | | 1/1999 | Kohara et al. | 68/23.2 |
| 5,916,274 | A | | 6/1999 | Lee et al. | 68/23.2 |

FOREIGN PATENT DOCUMENTS

| | | | | |
|---|---|---|---|---|
| JP | 21065 | * | 2/1979 | 68/23.2 |
| JP | 7517 | * | 2/1985 | 68/23.2 |

* cited by examiner

*Primary Examiner*—Philip Coe
(74) *Attorney, Agent, or Firm*—McKee, Voorhees & Sease, P.L.C.

(57) ABSTRACT

An improved fluid balance ring is provided with a plurality of standpipes within the cavity of the balance ring. The standpipes each have an open upper end spaced from the upper wall of the balance ring, and an open lower end extending through the bottom wall of the balance ring. The balance ring includes an inlet opening so that the ring can be substantially filled with water during the fill cycle of the tub. When the spin cycle of the tub begins, the added mass of the balance ring assists in getting the tub to the critical speed with minimum deflection. After reaching the critical speed, approximately ½ of the water is drained through the standpipes due to the centrifugal force and the remaining fluid moves to a balance position in the fluid ring to counter-act any unbalanced loads in the tub. In an alternative embodiment, the standpipes are replaced with drain openings in the top wall of the balance ring.

16 Claims, 4 Drawing Sheets

BALANCE RING

BACKGROUND OF THE INVENTION

The present invention relates to an improved fluid balance ring for rotating objects, such as a washing machine tub.

Fluid balance rings are well known for correcting unbalanced loads in rotating machines, such as the tub of a washing machine. Such fluid balance rings are effective at high rotational speeds to counterbalance unbalanced loads resulting from objects in the tub being unevenly distributed or off-center. An example of such a situation is a load of towels positioned along one side of the rotating washing machine tub, which create an unbalance. Such an unbalanced condition causes deflections in the rotating tub. The deflection of the unbalanced tub increases as the rotational speed of the tub increases, up to a critical speed, after which the deflections are minimized by the function of the fluid balance ring. The critical rotational speed varies from assembly to assembly, depending on the structure, mass, and geometry of the rotating assembly and its contents. The fluid within the balance ring counteracts the unbalanced load in the tub when the tub is rotating at high speeds.

One problem with prior art fluid balance rings is that the ring is only partially filled with fluid. Thus, the mass of the ring is insufficient to substantially reduce deflections of an unbalanced tub when the tub begins the spin cycle and is ramping up to its critical speed. Therefore the fluid balancing ring generally is not effective until the rotational speed of the tub reaches the critical speed.

Accordingly, a primary objective of the present invention is the provision of an improved fluid balance ring having sufficient mass to reduce tub deflections at low rotational speeds.

Another objective of the present invention is the provision of an improved method of balancing a rotating tub at low rotational speeds.

A further objective of the present invention is the provision of an improved fluid balance ring which is substantially filled with fluid at the beginning of the spin cycle, and approximately half full of fluid at the critical speed.

Another objective of the present invention is the provision of a fluid balance ring which is economical to manufacture, and durable and efficient in use.

These and other objectives will become apparent from the following description of the invention.

SUMMARY OF THE INVENTION

The fluid balance ring of the present invention is intended for use with rotating objects, such as a washing machine tub, so as to counterbalance unbalanced loads in the tub after the tub has reached its critical rotational speed, and to reduce tub deflections at rotational speeds below the critical speed. The balance ring is hollow so as to define a cavity therein. The ring is substantially filled with fluid, before the spin cycle begins, so as to provide sufficient mass to reduce deflections as the tub begins the spin cycle and ramps up through the critical speed. As the rotational velocity increases, approximately ½ of the fluid volume is drained from the ring. After the critical speed is reached, the remaining fluid is free to flow to a balancing position within the ring.

DETAILED DESCRIPTION OF THE INVENTION

Figure 1:
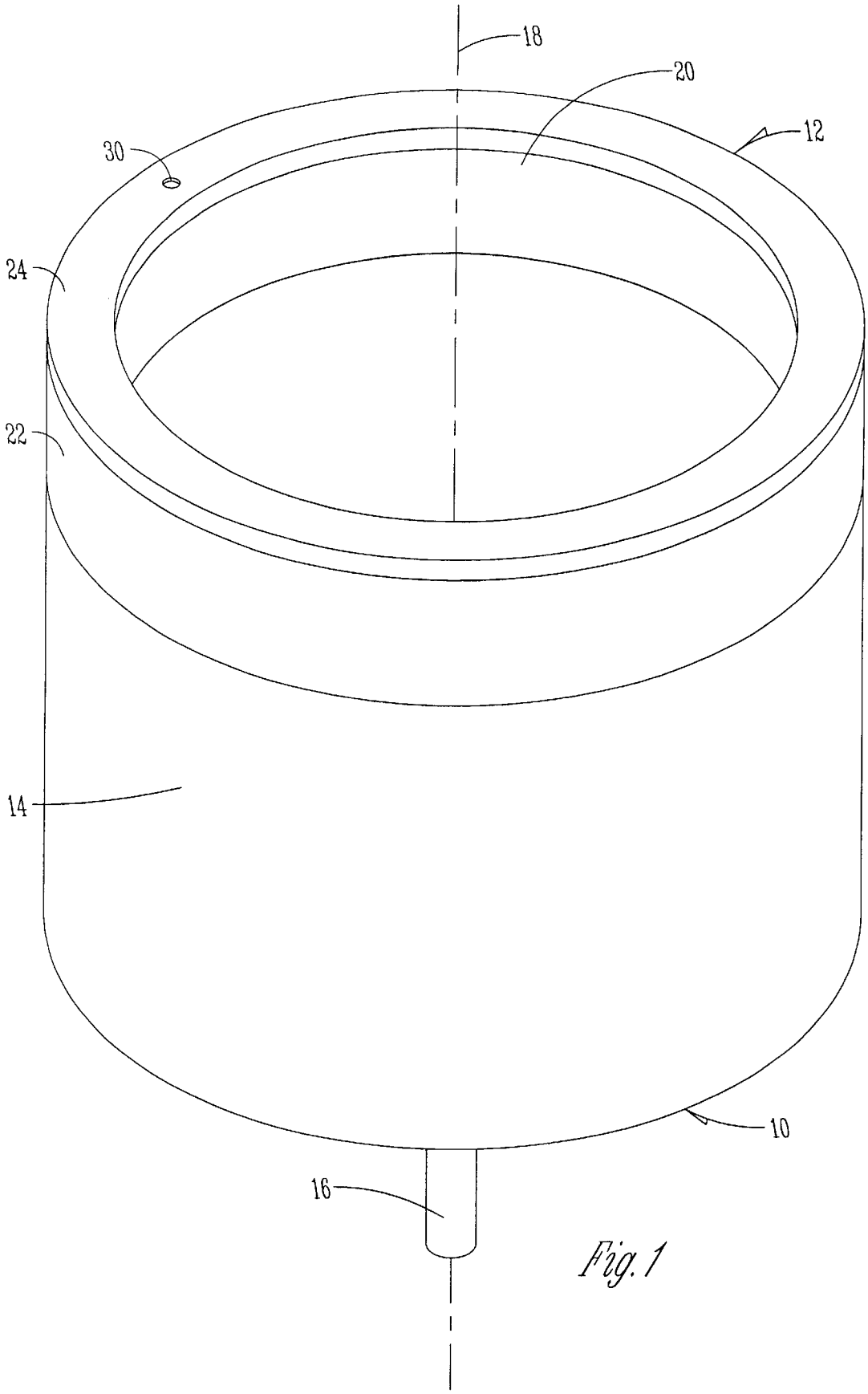
FIG. 1 is a perspective view of a washing machine tub utilizing the fluid balance ring of the present invention.
Figure 2:
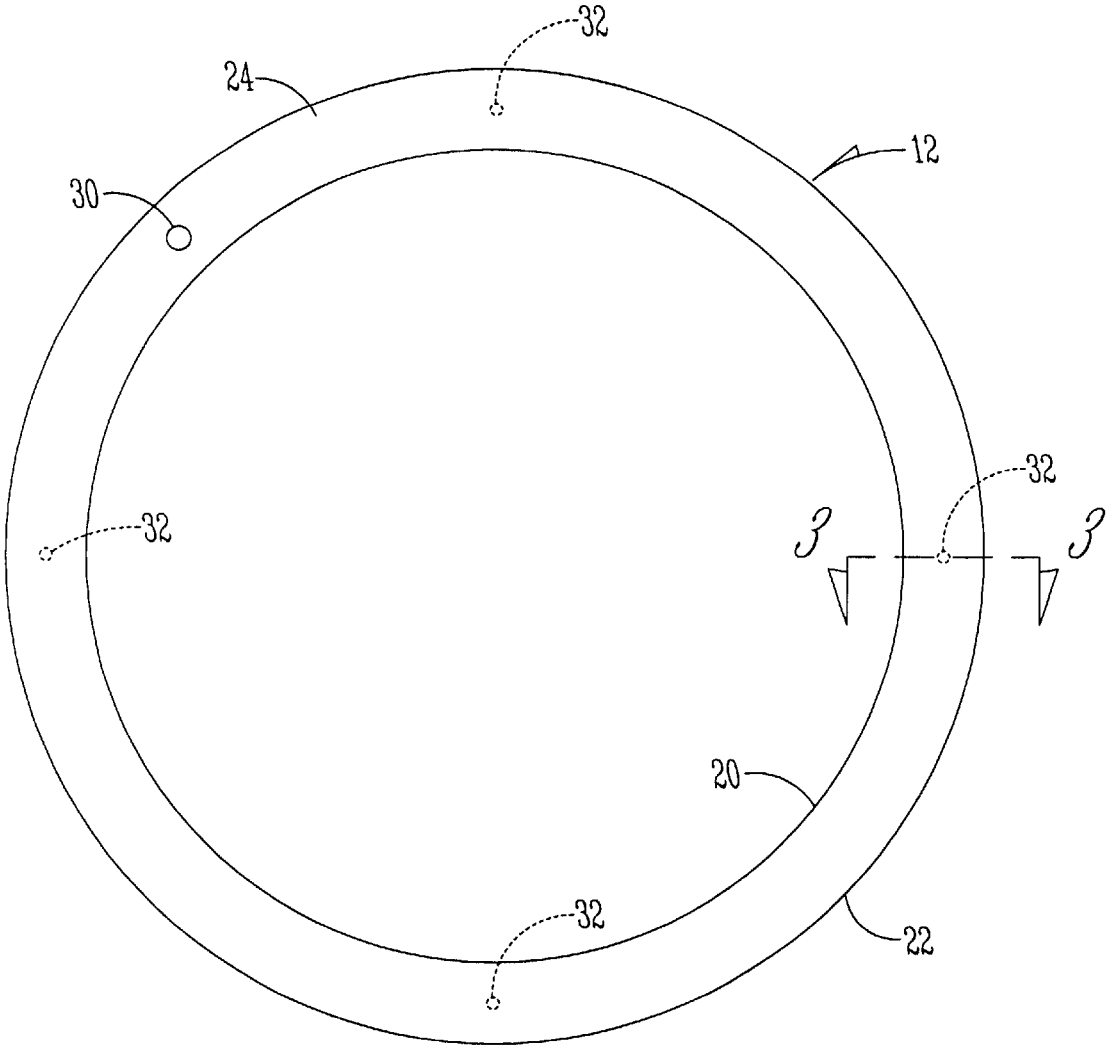
FIG. 2 is a top plan view of the balance ring.

With reference to the drawings, a rotatable tub, such as a washing machine tub, is generally designated by the reference numeral 10. A fluid balance ring 12 is mounted on top of the tub 10. The tub 10 includes a cylindrical sidewall 14 and is mounted upon a shaft 16 extending downwardly from the bottom of the tub 10. The shaft 16 defines a rotational axis 18, which is coaxial with the axis of the balance ring 12.

Figure 3:
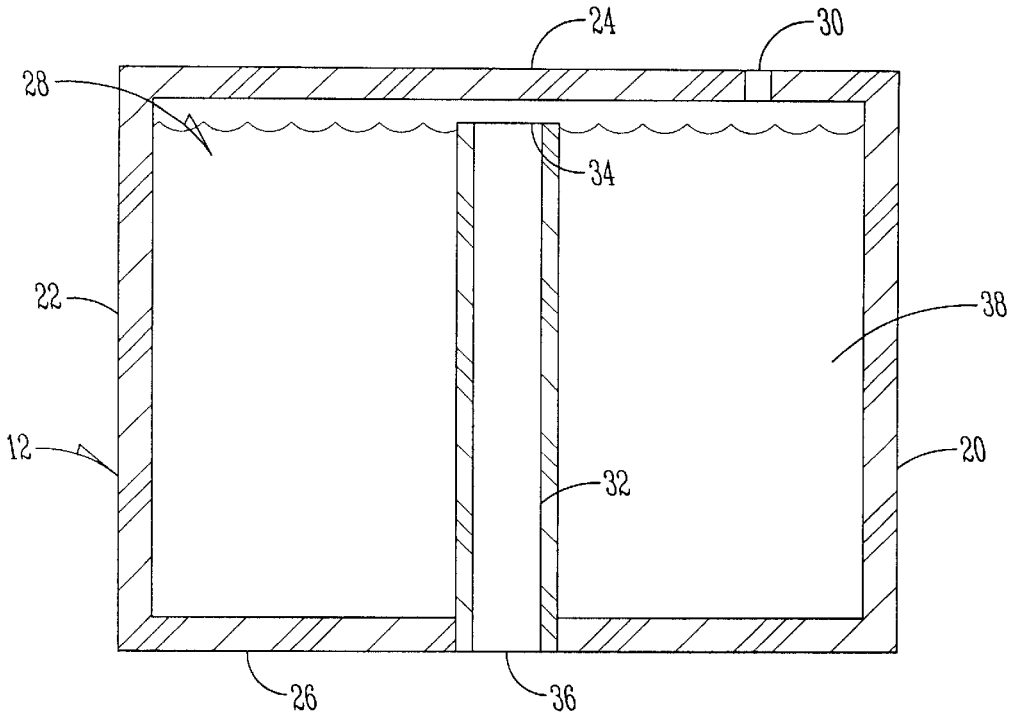
FIG. 3 is a sectional view taken along lines 3—3 of FIG. 2, with the balance ring being stationary.
Figure 4:
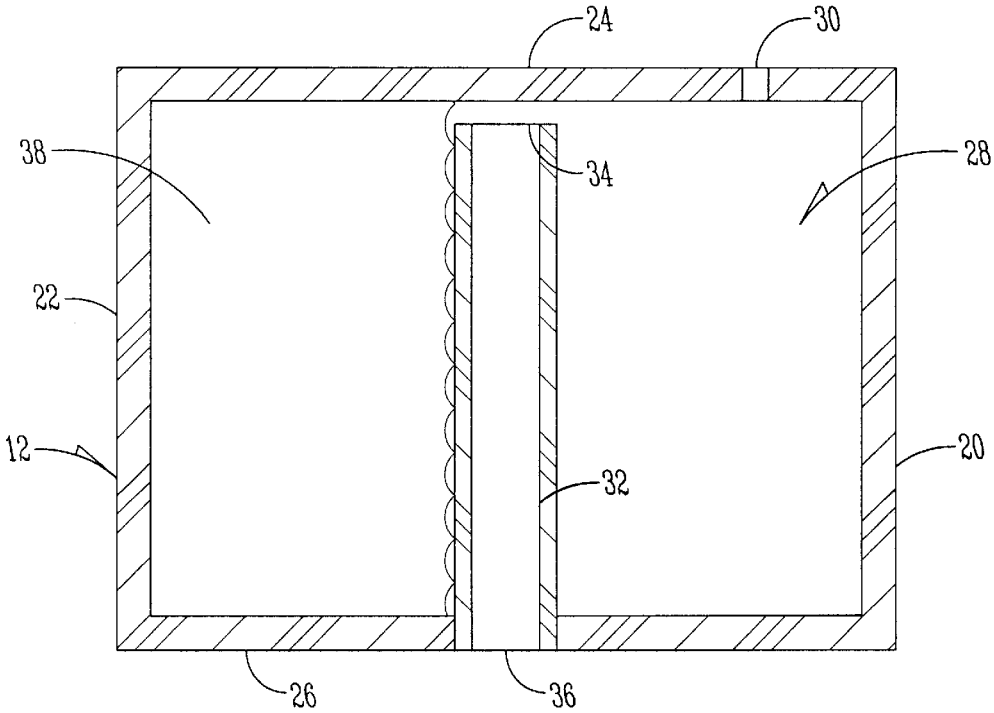
FIG. 4 is a view similar to FIG. 3 showing the balance ring which is rotating at least at or above the critical speed.

As best seen in FIGS. 3 and 4, the balance ring 12 is hollow, and includes an inner wall 20, and outer wall 22, an upper wall 24, and a lower wall 26. The walls 20, 22, 24 and 26 are sealed so as to define a cavity 28 therein.

The balance ring 12 includes an inlet opening 30 in the upper wall 24 thereof which permits water to be introduced into the cavity 28 during the fill portion of the washing machine cycle of operations. In a first embodiment, the balance ring 12 includes a plurality of standpipes or tubes 32 extending vertically within the cavity 28. The standpipes 32 include an open upper end 34 spaced apart from the upper wall 24, and an open lower end 36 which extends through the lower wall 26 of the balance ring 12. The standpipes 32 function as drains, with the lower ends 36 thereof being in communication with the interior of the tub 10.

In operation, the balance ring 12 is substantially filled with water 38 during the fill cycle of the tub 10, to a level reaching the upper ends 34 of the standpipes 32 as shown in FIG. 3. When the spin cycle for the tub 10 begins, the mass of the balance ring 12 assists in getting the rotating tub 10 through the critical speed with smaller deflections. As the rotational speed increases, the centrifugal force forces the water 38 toward the outer wall 22 of the balance ring 12, such that the water 38 flows into the upper ends 34 of the standpipes 32 for drainage out the lower ends 36 of the standpipes 32. When the rotating tub 10 exceeds the critical speed, approximately ½ the water 38 has been drained from the balance ring 12, as shown in FIG. 4. The remaining water 38 is free to flow to a balance position within the balance ring 12 so as to counterbalance unbalanced loads in the tub 10.

Figure 5:
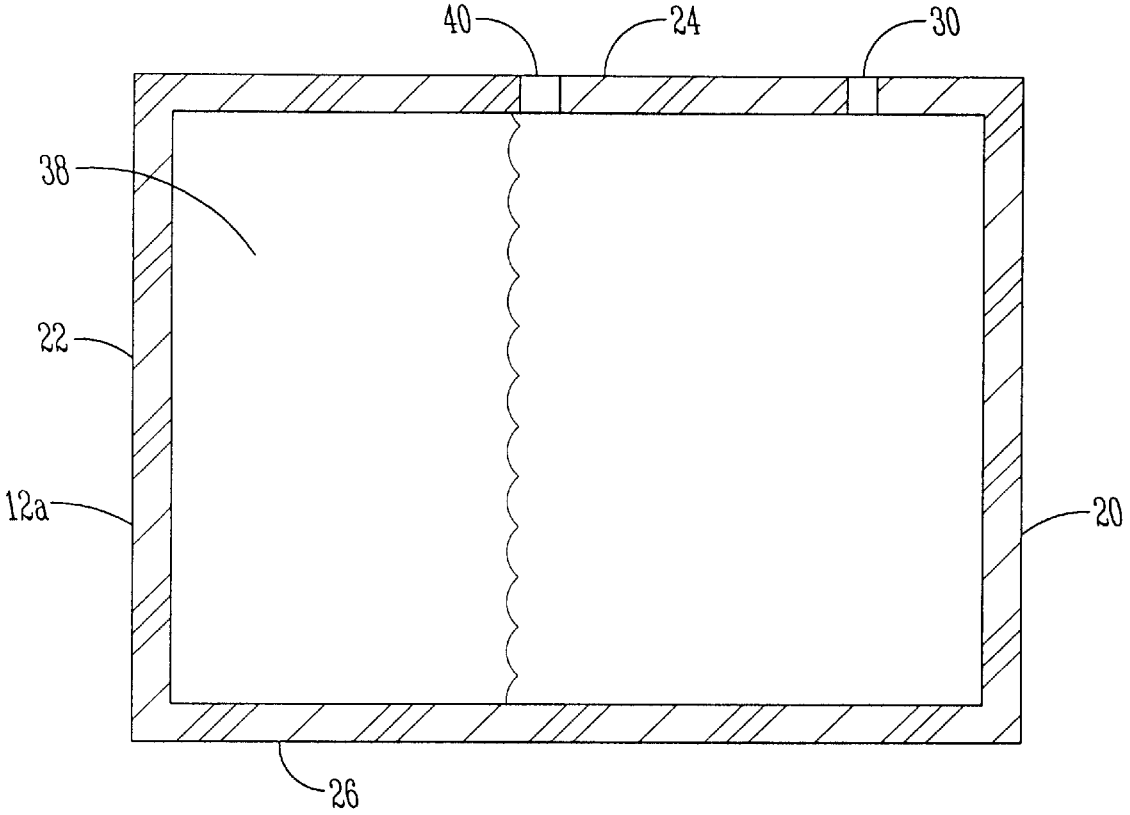
FIG. 5 is a view similar to FIG. 4 showing an alternative embodiment of the present invention.

In an alternative embodiment shown in FIG. 5, the standpipes 32 are replaced with at least one drain opening 40 in the upper wall 24 of the balance ring 12*a*. The balance ring 12*a* functions similarly to the balance ring 12 shown in FIGS. 3 and 4, with the water 38 draining through the drain opening(s) 40 when the tub 10 is ramping up to the critical speed, and the remaining water being free to flow within the cavity 28 to a balance position counter-acting any uneven load in the tub 10.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A fluid balance ring for balancing a tub rotating about a tub axis, comprising:

a hollow ring mounted on the tub and having upper and lower walls and inner and outer walls;

a plurality of drain openings in the ring; and a balancing fluid substantially filling the ring when the ring is stationary, with a portion of the fluid flowing out of the drain openings as the rotational speed of the ring increases.

2. The fluid balance ring of claim 1 further comprising a plurality of standpipes each having an open upper end within the ring and an open lower end defining one of the drain openings.

3. A fluid balance ring of claim 2 wherein the upper end of each standpipe is spaced from the upper wall of the ring.

4. A fluid balance ring of claim 2 wherein the lower end of each standpipe extends through the lower wall of the ring.

5. The fluid balance ring of claim 2 wherein the fluid has a depth substantially equal to the height of the standpipes before rotating the ring.

6. The fluid balance ring of claim 1 wherein the drain openings are in the upper wall of the ring.

7. A fluid balance ring of claim 1 wherein the ring includes an inlet for introducing fluid into the ring.

8. An improved fluid balance ring for a rotating tub, the ring including walls defining a circumferential cavity, the cavity containing fluid, the improvement comprising:

a plurality of drain openings in the ring such that a portion of the fluid is forced out of the ring at higher rotation speeds so that a remaining portion of fluid is flowable within the ring to a balancing position.

9. The improved fluid balance ring of claim 8 wherein the fluid substantially fills the cavity before rotation of the tub.

10. The improved fluid balance ring of claim 9 wherein the fluid fills approximately ½ the cavity after the tub exceeds a critical speed.

11. The improved fluid balance ring of claim 8 wherein the ring includes an inlet for introducing fluid into the ring.

12. The improved fluid ring of claim 8 further comprising a plurality of standpipes each having an open upper end within the ring and an open lower end defining one of the drain openings.

13. The improved fluid ring of claim 8 wherein the drain openings are on an upper wall of the ring.

14. A method of balancing a rotating tub using a hollow balance ring mounted on the tub, comprising:

substantially filling the ring with fluid;

rotating the tub;

draining a portion of the fluid from the ring as the ring rotates and leaving a remaining portion of fluid in the ring; and allowing the remaining portion of fluid to flow to a balancing position in the ring.

15. The method of claim 14 wherein the draining is through a plurality of standpipes mounted in the ring and having an open upper end within the ring and an open lower end extending through the ring.

16. The method of claim 14 wherein the draining is through a plurality of holes in an upper wall of the ring.

* * * * *